US005104312A

United States Patent [19]

Dowst et al.

[11] Patent Number: 5,104,312

[45] Date of Patent: Apr. 14, 1992

[54] MANTLE TECHNOLOGY

[75] Inventors: William P. Dowst, Lynnfield; Brendan P. McFadden, Brockton; Robert E. Nelson, Weston; Jens F. S. Olow, Waltham, all of Mass.

[73] Assignee: TPV Energy Systems, Inc., Waltham, Mass.

[21] Appl. No.: 507,597

[22] Filed: Apr. 10, 1990

[51] Int. Cl.[5] ..... F21V 19/06

[52] U.S. Cl. ..... 431/112; 431/100; 431/101

[58] Field of Search ..... 431/100, 101, 107, 109, 431/111, 112, 113; 362/179

[56] References Cited

U.S. PATENT DOCUMENTS

| | | | |
|---|---|---|---|
| 768,382 | 8/1904 | Liais | 431/111 |
| 795,917 | 8/1905 | Kaufman | 431/111 X |
| 862,681 | 8/1907 | Fuchs . | |
| 898,957 | 9/1908 | Barton | 431/113 |
| 927,725 | 7/1909 | Herskovitz . | |
| 937,483 | 10/1909 | Steil . | |
| 991,099 | 5/1911 | Stinack . | |
| 1,192,782 | 7/1916 | Herskovitz . | |
| 1,227,260 | 5/1917 | Gotty . | |
| 1,320,281 | 10/1919 | Schroeder | 431/109 |
| 1,906,255 | 5/1933 | Engh . | |
| 2,703,000 | 3/1955 | Hebard . | |
| 3,240,036 | 3/1966 | Hebard . | |
| 3,589,850 | 6/1971 | Teeter . | |
| 3,796,534 | 3/1974 | Andrews | 431/112 |

*Primary Examiner*—Carl O. Price

*Attorney, Agent, or Firm*—Fish & Richardson

[57] ABSTRACT

An incandescent gas mantle assembly includes a metal coupling member and a mantle supporting sleeve member of thermally resistant material that has a skirt portion to which a metal oxide mantle sock is secured in depending relation. The metal coupling member has a body portion of disc configuration with an outer periphery and an inner periphery, a plurality of inwardly extending first coupling portions integral with and spaced about the body portion for attachment to a cooperating burner head, and a plurality of second coupling portions integral with and spaced about the body portion, the second coupling portions being in coupling engagement with recess structure of the mantle supporting sleeve member.

20 Claims, 3 Drawing Sheets

MANTLE TECHNOLOGY

This invention relates to mantle assemblies for mounting incandescent gas mantles on the discharge port of a burner head of gas appliances such as camping lanterns, street lights, and the like.

BACKGROUND OF THE INVENTION

As is well known, gas mantles of various metal oxide fabric structures become incandescent when heated in a gas flame. Such mantle structures are relatively fragile and easily broken. Such incandescant gas mantles are used with a variety of burner head structures. Two attachment arrangements are in common use—a first arrangement employing a drawstring or similar cord of thermally stable material (such as ceramic yarn or refractory metal wire) for tying a rag mantle to a burner head, and a second arrangement employing a ceramic support ring and preformed mantle assembly, the mantle assembly support ring having integral inwardly extending rigid fingers designed to rest on lugs carried by the burner head. In the usual situtation, the support ring for the mantle assembly is moved upwardly so that the fingers on the ring pass through spaces defined between the lugs. The mantle assembly is then rotated until the fingers are positioned above the lugs and then the mantle assembly is allowed to drop downwardly so that the fingers rest on the lugs.

Gas lights are incorporated in portable lanterns and in fixed installations that are often mounted on lamp poles. Mantle replacement is necessitated because of the fragile nature of the mantle. When a pole supporting a mantle assembly is jarred, the very light and fragile mantle may be bounced to the extent that it will be dislodged from its position on the burner head at the end of the fuel supply conduit, and if the dislodging causes the mantle to fall or otherwise come in contact with an adjacent solid surface, the mantle fabric will disintegrate.

SUMMARY OF THE INVENTION

In accordance with one aspect of the invention there is provided an incandescent gas mantle assembly that includes a mantle supporting sleeve member of thermally resistant material, the sleeve member having a skirt portion to which mantle structure is secured in supporting relation and recess structure spaced from the skirt portion. A metal coupling member is in coupled juxtaposition with the sleeve member, the coupling member having a plurality of inwardly extending first integral coupling portions for attachment to a cooperating burner head, and a plurality of second integral coupling portions in coupling engagement with the recess structure of the mantle supporting sleeve member.

Preferably, the mantle is manufactured in accordance with the process described in Diederich U.S. Pat. No. 4,883,619, the disclosure of which is expressly incorporated herein by reference.

In preferred embodiments, each first coupling portion is in the form of a depending spring finger that includes a camming portion; and each second coupling portion is in the form of a tongue member that extends downwardly from the body portion; and the mantle structure is of metal oxide fibers of sock configuration with a closed lower end and an annular upper portion secured to the skirt portion of the sleeve member. In particular embodiments, the mantle structure is a sleeve fabric of metal oxide fibers and has a length in the range of about two to about six centimeters and a skirt diameter in the range of about one to about four centimeters.

In particular embodiments, the coupling member has a body portion of annular configuration, and the first and second coupling portions are integral with and equidistantly spaced about the body portion. In one embodiment, the coupling member includes inwardly extending stop structure for seating against the lower end of the cooperating burner head for limiting upward movement of said mantle assembly on said burner head; and in another embodiment, the metal coupling member includes a horizontal base portion of disc configuration and an annular flange portion upstanding from the outer periphery of said base portion. In particular embodiments, each second coupling portion is in the form of a downwardly extending tongue member, and each tongue member includes an upwardly extending flexed latch finger portion.

Mantle assemblies in accordance with the invention provide convenient, versatile and reliable attachment of mantles to a variety of burner heads.

Other features and advantages of the invention will be seen as the following description of particular embodiments progresses, in conjunction with the drawing, in which.

DESCRIPTION OF PARTICULAR EMBODIMENTS

Figure 1:
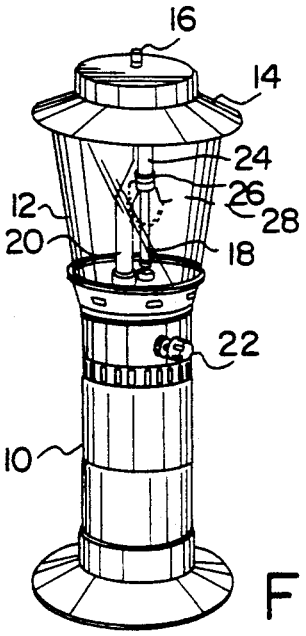
FIG. 1 is a diagrammatic view of a conventional portable lantern of the incandescent gas mantle type.

The lantern shown in FIG. 1 is of the Coleman camping lantern type and includes base 10 that houses a fuel supply. Seated on base 10 is frustoconical transparent sleeve member 12 that is secured in place by cover 14 and fastener 16. Extending up from base 10 is fuel supply tube 18 and air conduit 20 that connect to a mixer from which depends burner tube 24 with burner head 26 for receiving a mantle (indicated in dash lines at 28). The flow of fuel is controlled by control 22. Tube 20 is disposed close to the mantle assembly for providing preheat of air flowing to the mixer and the burner head 26.

Mantle 28 is a fabric of metal oxide fibers. In a particular embodiment, the mantle is of sock configuration with a closed lower end, an annular upper end of about 2.5 centimeters diameter, and a length of about three centimeters.

Figure 2A:
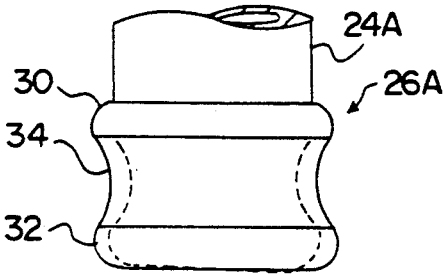
FIG. 2A (PRIOR ART)
FIGS. 2A–2E are diagrammatic views of types of burner head mantle coupling structures.
Figure 2B:
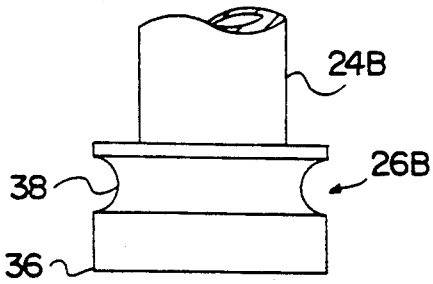
FIG. 2B (PRIOR ART)
Figure 2C:
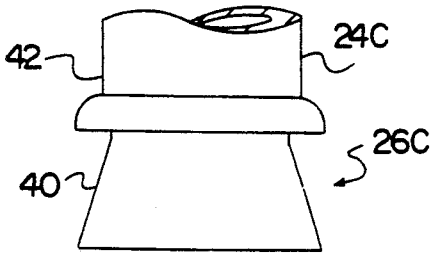
FIG. 2C (PRIOR ART)
Figure 2D:
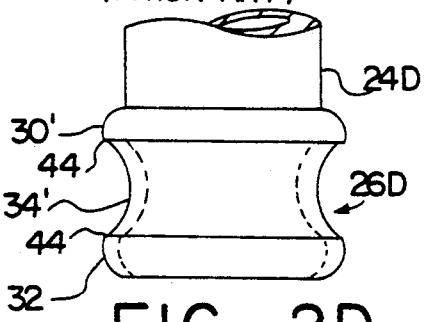
FIG. 2D (PRIOR ART)
Figure 2E:
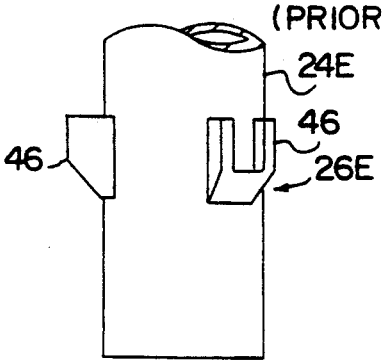
FIG. 2E (PRIOR ART)

The burner head 26 may take a variety of forms. The burner head 26A shown in FIG. 2A has smoothly curved upper and lower collar portions 30, 32 of about 1.8 centimeters diameter that are spaced by an annular recess 34 (of about 1.6 centimeters diameter at its base and a height (between collar portions 30, 31) of about 0.8 centimeter) (the configuration of a similar head of smaller dimension being indicated in dash lines); head 26B shown in FIG. 2B is about two centimeters in diameter and about one centimeter in height with cylindrical base 36 and annular groove 38 of semicircular cross section form (a depth of about two millimeters and a width of about ½ centimeter); the head 26C shown in FIG. 2C has flared skirt 40 of about one centimeter length that tapers from a diameter of about 1.7 centimeters to a diameter of about 1.5 centimeters adjacent collar portion 42 that has a diameter of about 1.8 centimeters; the burner head 26D shown in FIG. 2D is similar in configuration to the burner head 26A but smoothly curved upper and lower collar portions 30', 32' (of about 1.9 centimeters diameter) that have ledges at the transitions 44 to annular recess 34' (that has a base diameter of about 1.6 centimeters and a height (between ledge transitions 44) of about 0.8 centimeter) (the configuration of a similar head of smaller dimension being indicated in dash lines); and the burner head 26E shown in FIG. 2E is about one centimeter in diameter with three protruding lugs 46, and a length of about one centimeter below the lugs 46. The burner heads shown in FIGS. 2A–D are typically used in portable lanterns with rag mantles that are tied on with a cord while the burner head 26E is typically used on a fixed gaslight installation with a preformed mantle mounted on a support ring that has integral inwardly extending rigid fingers.

Figure 4:
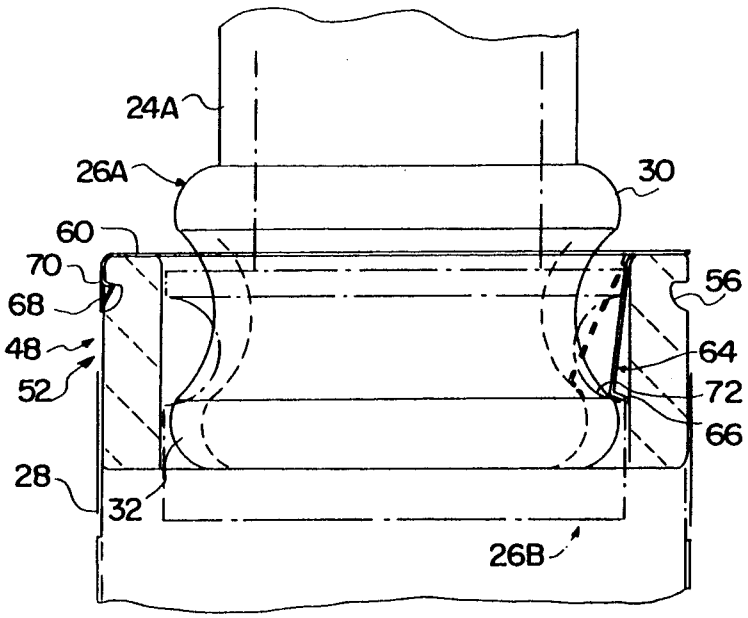
FIG. 4 is a sectional diagrammatic view of the mantle support assembly of FIG. 3 on a burner head together with alternate burner head configurations shown as superimposed dashed indications.
Figure 3:
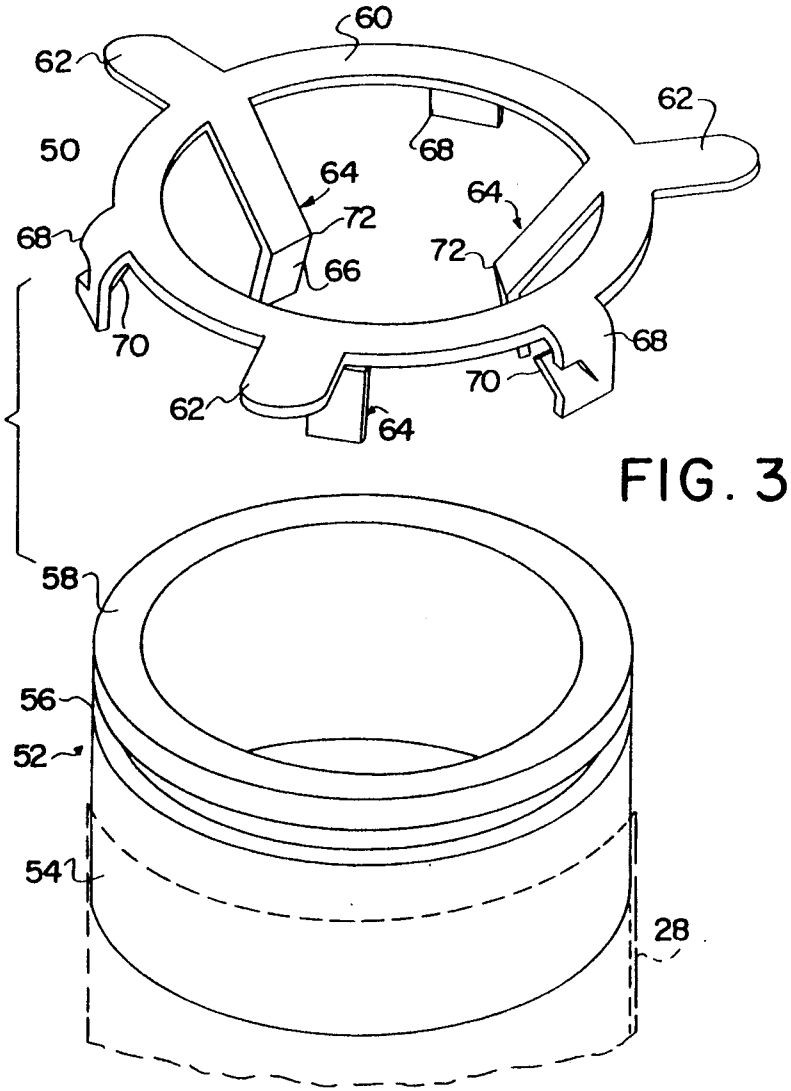
FIG. 3 is an exploded diagrammatic view of components of a first embodiment of a mantle support assembly in accordance with the invention.

The mantle assembly 48 shown in FIGS. 3 and 4 includes sheet metal member 50 of suitable metal such as stainless steel or aluminized steel that has a thickness of about 0.1 millimeter and cylindrical coupling sleeve 52 of suitable ceramic material such as mullite that has an outer diameter of about 2.5 centimeters, an inner diameter of about 2.3 centimeters, and a height of about one centimeter. Coupling sleeve 52 has skirt portion 54 and groove 56 that has an upper edge about one millimeter from upper surface 58 of member 52, a width of about 1.6 millimeter and a depth of about ½ millimeter. Metal member 50 has circular body portion 60 of about 2½ centimeters outer diameter and about two centimeters inner diameter with three integral outwardly-extending radial projections 62; three integral spring fingers 64 generally aligned with projections 62, each with an inclined camming portion 66; and three integral depending latch tabs 68, each of which has a flexed latch finger 70 that extends inwardly beneath the outer perimeter of body portion 60. Each spring finger 64 has a width of about three millimeters and a length of about eight millimeters and its peak 72 projects inwardly about four millimeters from the inner periphery of body 60.

In manufacture, a ceramic post that has a ledge which receives ceramic ring 52 is used. A circular bead of glass frit is placed around the ceramic ring 52, that ring is placed on the ceramic post in inverted position, and a dried rayon preform (of mantle sock configuration and that has been imbibed in a thoria ceria solution) is hung on the fixture post with fugitive rings of cotton felt and Tyvek paper properly positioning the dried rayon preform. The ring rayon preform is subjected to a firing and densifying sequence of the type described in Diederich U.S. Pat. No. 4,883,619 in which the mantle and sleeve subassembly is subjected to temperatures up to about 1600° C., the mantle fabric 28 being shrunk to about one-third its original dimensions with its open end firmly secured by shrinking onto the skirt portion 54 of sleeve 52 to create a sturdy metal oxide mantle 28. During the furnace processing, the fugitive support rings are burned out and the ceramic mantle 28 shrinks snugly around the support sleeve 52 and the glass frit softens to firmly bond the mantle 28 to the ceramic ring 52. The mantle-ring subassembly is removed from the furnace and from its fixturing tube; the mantle ring subassembly is burned for ten minutes in a 750 Watt stoichiometric propane/air flame; an easily flammable polymer coating is then applied to the mantle 28 for protection during transportation; and the metal ring clip 50 is attached to the ceramic ring by snapping the latch fingers 70 of coupling member 50 are snapped into groove 56 with body 60 seated on top surface 58, as indicated in FIG. 4 to provide a mantle support assembly which then is attached to burner head 26 by sliding the mantle assembly 48 upwardly onto the burner head 26. Spring fingers 64 are cammed over collar 32 and seated in recess 34. The assembly 48 is usable with a variety of burner head configurations as indicated in FIG. 4, including all the burner heads shown in FIG. 2.

Figure 5:
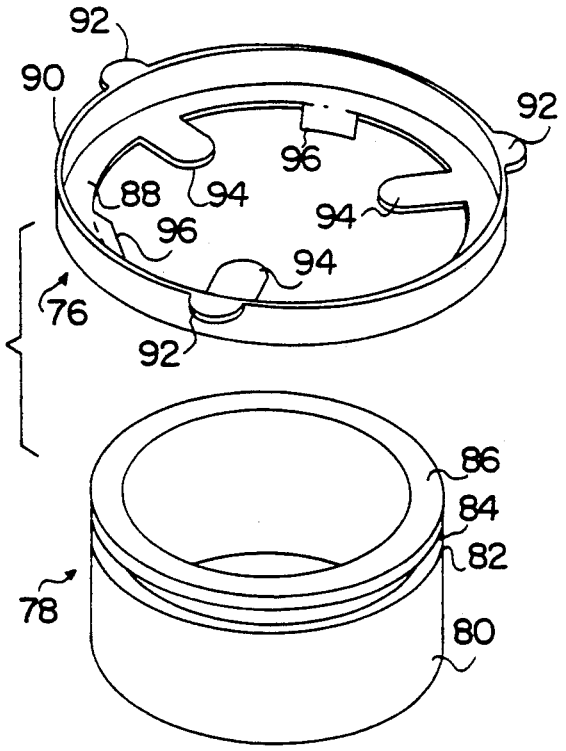
FIG. 5 is an exploded diagrammatic view of components of a second embodiment of a mantle support assembly in accordance with the invention.
Figure 6:
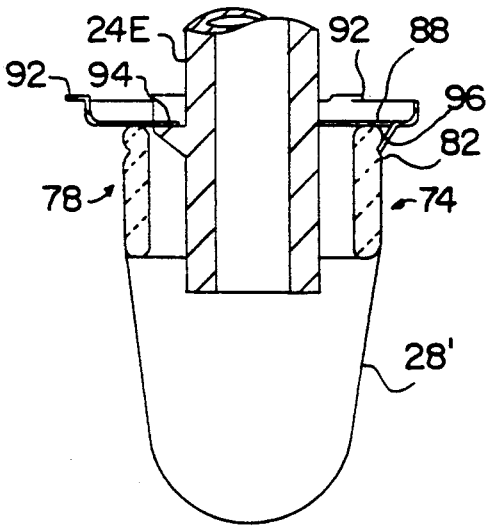
FIG. 6 is a sectional diagrammatic view of the mantle support assembly of FIG. 5 on a burner head.

A second embodiment shown in FIGS. 5 and 6 is particularly adapted for use with a burner head of the type shown in FIG. 2E. The mantle support assembly 74 shown in FIGS. 5 and 6 includes sheet metal member 76 of suitable metal such as stainless steel or aluminized steel of about 0.2 millimeter thickness and cylindrical coupling sleeve 78 of suitable ceramic material such as mullite that has an outer diameter of about 2.4 centimeters, an inner diameter of about 2.2 centimeters, and a height of about one centimeter. Coupling sleeve 78 has a skirt portion 80 to which mantle sock 28' is attached and groove 82 that has an upper edge 84 about one millimeter from the upper surface 86 of sleeve 78. Groove 82 has a width of about 1.6 millimeter and a depth of about ½ millimeter. Metal member 76 has horizontal base 84 of about 2½ centimeters outer diameter and about two centimeters inner diameter and upwardly turned cylindrical flange 90 that is integral with and upstands from the outer periphery of base 88. Three integral outwardly extending radial projections 92 are equally spaced about the upper edge of flange 90; three integral support fingers 94 are generally aligned with projections 92 and extend inwardly from the inner periphery of base 86; and three integral latch tabs 96 depend from the inner periphery of base 86 equidistant from support fingers 92. Each latch tab 96 may be flexed outwardly by exerting inward pressure on flange 88 immediately above the latch tab (as indicated by arrow 96 in FIG. 6) so that the latch tabs 96 may be received in groove 82 to secure metal member 76 to sleeve 78 as indicated in FIG. 6.

Figure 7:
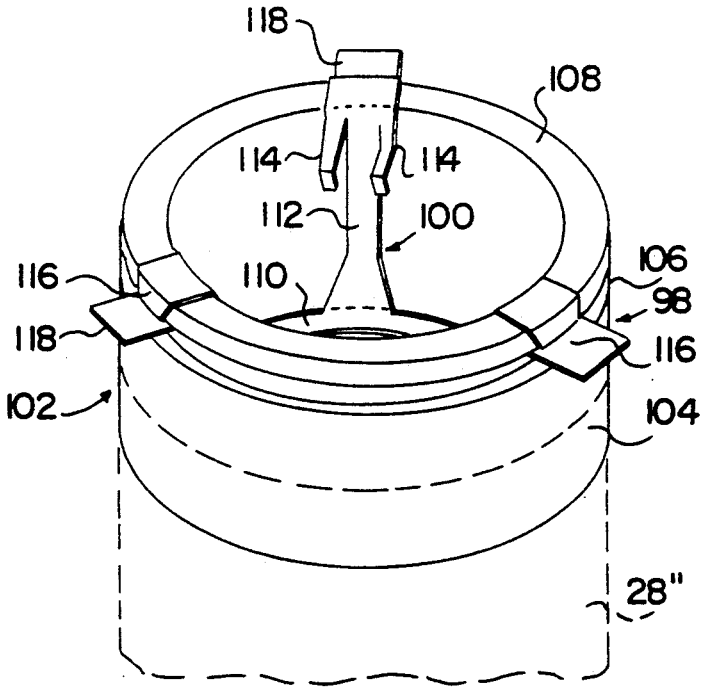
FIG. 7 is a perspective view of a third embodiment of a mantle support assembly in accordance with the invention.

A third embodiment shown in FIG. 7. The mantle support assembly 98 includes sheet metal member 100 and cylindrical ceramic coupling sleeve 102. Coupling sleeve 102 has skirt portion 104 to which mantle sock 28'' is attached and groove 106 adjacent upper surface 108 of sleeve 102. Metal member 100 has cylindrical stop portion 110 and three upwardly extending webs 112 that extend along the inner surface of sleeve 102. At the top of each web are formed a pair of spring fingers 114, and a clip portion 116 that extends over the upper surface 108 of sleeve 102 and snaps into groove 106, each clip portion having a projecting tab 118. The mantle support assembly is then attached to a burner head 26 by sliding the mantle assembly upwardly onto the burner head. Spring fingers 114 are cammed over and resiliently coupled to the burner head. The assembly is usable with a variety of burner head configurations, including all the burner heads shown in FIG. 2.

While particular embodiments of the invention has been shown and described, various modifications will be apparent to those skilled in the art, and therefore it is not intended that the invention be limited to the disclosed embodiments or to details thereof, and departures may be made therefrom within the spirit and scope of the invention.

What is claimed is:

1. An incandescent gas mantle assembly comprising a mantle supporting sleeve member of thermally resistant material, said sleeve member having a skirt portion for receiving mantle structure in supporting relation and recess structure spaced from said skirt portion;

mantle structure secured to said skirt portion; and a metal coupling member in juxtaposition with said sleeve member, said coupling member having a plurality of first integral inwardly extending spring finger coupling portions for attachment to a cooperating burner head, and a plurality of second integral coupling portions in coupling engagement with said recess structure of said mantle supporting sleeve member.

2. The assembly of claim 1 wherein said coupling member has a body portion of annular configuration, and said first and second coupling portions are integral with and spaced about said body portion.

3. The assembly of claim 1 wherein said sleeve member is of ceramic material, and said mantle structure is of metal oxide fabric structure.

4. The assembly of claim 1 wherein said mantle structure is of metal oxide fibers of sock configuration with a closed lower end and an annular upper portion secured to said skirt portion of said sleeve member.

5. The assembly of claim 1 wherein said mantle structure is a fabric sleeve of metal oxide fibers and has a length in the range of about two to about six centimeters and a skirt diameter in the range of about one to about four centimeters.

6. The assembly of claim 1 wherein each said first coupling portion is in the form of a depending spring finger that includes an inclined camming portion; and each said second coupling portion is in the form of an inwardly extending latch portion.

7. The assembly of claim 6 wherein said sleeve member is of ceramic material, and said mantle structure is of metal oxide material.

8. The assembly of claim 7 wherein said mantle structure is a sleeve fabric of metal oxide fibers and has a length in the range of about two to about six centimeters and a skirt diameter in the range of about one to about four centimeters.

9. An incandescent gas mantle assembly comprising a mantle supporting sleeve member of thermally resistant material, said sleeve member having a skirt portion for receiving mantle structure in supporting relation and recess structure spaced from said skirt portion;

mantle structure secured to said skirt portion; and a metal coupling member in juxtaposition with said sleeve member, said coupling member having a plurality of first integral inwardly extending spring finger coupling portions for attachment to a cooperating burner head, and a plurality of second integral coupling portions in coupling engagement with said recess structure of said mantle supporting sleeve member, each said second coupling portion being in the form of a downwardly-extending tongue member.

10. An incandescent gas mantle assembly comprising a mantle supporting sleeve member of thermally resistant material, said sleeve member having a skirt portion for receiving mantle structure in supporting relation and recess structure spaced from said skirt portion;

mantle structure secured to said skirt portion; and a metal coupling member in juxtaposition with said sleeve member, said coupling member having a plurality of first integral coupling portions for attachment to a cooperating burner head, and a plurality of second integral coupling portions in coupling engagement with said recess structure of said mantle supporting sleeve member, each said second coupling portion being in the form of a downwardly-extending tongue member that includes an upwardly-extending flexed latch finger portion.

11. An incandescent gas mantle assembly comprising a mantle supporting sleeve member of thermally resistant material, said sleeve member having a skirt portion for receiving mantle structure in supporting relation and recess structure spaced from said skirt portion;

mantle structure secured to said skirt portion; and a metal coupling member in juxtaposition with said sleeve member, said coupling member having a plurality of first integral depending spring finger coupling portions for attachment to a cooperating burner head, and a plurality of second integral coupling portions in coupling engagement with said recess structure of said mantle supporting sleeve member, each said second coupling portion being in the form of a downwardly-extending tongue member that includes an inwardly extending latch portion.

12. The assembly of claim 11 wherein said coupling member has a body portion of annular configuration, and said first and second coupling portions are integral with and spaced about said body portion.

13. The assembly of claim 12 wherein said body portion includes an inwardly extending stop portion for seating against the lower end of the cooperating burner head for limiting upward movement of said mantle assembly on said burner head.

14. The assembly of claim 12 wherein said metal coupling member includes a horizontal base portion of disc configuration and an annular flange portion upstanding from the outer periphery of said base portion.

15. An incandescent gas mantle assembly comprising a mantle supporting sleeve member of thermally resistant material, said sleeve member having a skirt portion for receiving mantle structure in supporting relation and recess structure spaced from said skirt portion;

mantle structure secured to said skirt portion; and a metal coupling member in juxtaposition with said sleeve member, said coupling member having a plurality of first integral coupling portions for attachment to a cooperating burner head, each said first coupling portion being in the form of a depending spring finger; and a plurality of second integral coupling portions in coupling engagement with said recess structure of said mantle supporting sleeve member, each said second coupling portion being in the form of an inwardly extending latch portion.

16. The assembly of claim 15 wherein said sleeve member is of ceramic material, and said mantle structure is of metal oxide fabric structure.

17. The assembly of claim 16 wherein said mantle structure is a fabric sleeve of metal oxide fibers and has a length in the range of about two to about six centimeters and a skirt diameter in the range of about one to about four centimeters.

18. An incandescent gas mantle assembly comprising a mantle supporting sleeve member of thermally resistant material, said sleeve member having a skirt portion for receiving mantle structure in supporting relation and recess structure spaced from said skirt portion;

mantle structure secured to said skirt portion; and a metal coupling member in juxtaposition with said sleeve member, said coupling member having inwardly extending stop structure for seating against the lower end of the cooperating burner head for limiting upward movement of said mantle assembly on said burner head, a plurality of first integral coupling portions for attachment to a cooperating burner head, and a plurality of second integral coupling portions in coupling engagement with said recess structure of said mantle supporting sleeve member.

19. An incandescent gas mantle assembly comprising a mantle supporting sleeve member of thermally resistant material, said sleeve member having a skirt portion for receiving mantle structure in supporting relation and recess structure spaced from said skirt portion;

mantle structure secured to said skirt portion; and a metal coupling member in juxtaposition with said sleeve member, said coupling member having a horizontal base portion of disc configuration, an annular flange portion upstanding from the outer periphery of said base portion, and a plurality of first integral coupling portions for attachment to a cooperating burner head, and a plurality of second integral coupling portions in coupling engagement with said recess structure of said mantle supporting sleeve member.

20. The assembly of claim 19 wherein said sleeve member is of ceramic material, and said mantle structure is a fabric sleeve of metal oxide fibers and has a length in the range of about two to about six centimeters and a skirt diameter in the range of about one to about four centimeters.

* * * * *